United States Patent [19]

Randolph

[11] 4,134,695

[45] Jan. 16, 1979

[54] PRINTER CARRIAGE

[75] Inventor: John E. Randolph, Palatine, Ill.

[73] Assignee: Teletype Corporation, Skokie, Ill.

[21] Appl. No.: 815,132

[22] Filed: Jul. 13, 1977

[51] Int. Cl.[2] ..... B41J 25/30

[52] U.S. Cl. ..... 400/320; 400/59; 400/124; 400/352; 400/356

[58] Field of Search ..... 197/1 R, 60, 82, 151; 101/93.04, 93.05; 400/59, 124, 320, 320.1, 352, 355, 356

[56] References Cited

U.S. PATENT DOCUMENTS

| | | | |
|---|---|---|---|
| 3,910,395 | 10/1975 | Colglazier et al. | 197/1 R |
| 3,960,256 | 6/1976 | Bickoff et al. | 197/55 X |
| 3,982,622 | 9/1976 | Bellino et al. | 197/1 R |
| 3,990,560 | 11/1976 | Pavliscak et al. | 197/1 R |
| 4,023,662 | 5/1977 | Perucca | 197/1 R |

*Primary Examiner*—Paul T. Sewell

*Attorney, Agent, or Firm*—J. C. Albrecht

[57] ABSTRACT

A carriage for positioning a print mechanism in front of a record medium and moving the print mechanism back and forth in front of the record medium with facility for retracting the print mechanism to permit insertion of a ribbon and biasing the print mechanism forward toward the record medium against an adjustable stop. The retracting mechanism being further adjustable for retracting the printing mechanism completely out of the carriage for removal therefrom.

7 Claims, 5 Drawing Figures

PRINTER CARRIAGE

FIELD OF THE INVENTION

The present apparatus relates to printing machines and particularly to a carriage apparatus for mounting, moving, and positioning a print mechanism in a path across the width of a record medium.

BACKGROUND OF THE INVENTION

U.S. Pat. No. 3,982,622 granted on Sept. 28, 1976, to J. A. Bellino, et al. discloses a printing apparatus including a print mechanism which is intended to ride on a carriage which moves across the width of a record medium. The Bellino et al. mechanism contemplates an inking ribbon positioned between the print mechanism and the record medium. However, the ribbon must not be permitted to touch the paper except as required by the print mechanism in order to form indicia on the record. Any other random touching of the ribbon to the record medium risks smudging or undesirably marking the record medium and is to be avoided. In addition, a fresh ribbon is to be readily mounted in the printer.

The printing mechanism of the Bellino et al. patent is a matrix printer with which elements of the matrix are controlled by an individual print magnet. Axial movement of the printing element (wire) toward and away from the record medium occurs preferably over a minimum of length in order to facilitate the desirably rapid printing. This leaves very little room for neatly and cleanly inserting a fresh ribbon between the record medium and a closely-adjacent print mechanism.

It is desirable to retract the print mechanism during ribbon insertion; however, any adjustment in the ribbon positioning must not be upset. Disturbing any print mechanism adjustments would greatly impair ribbon replacement as these adjustments are normally done by a skilled service-person which skill is not usually present in an operator.

SUMMARY OF THE INVENTION

The present invention relates to a carriage apparatus for mounting a print mechanism by engaging the print mechanism and offering the print mechanism a degree of movement in a direction perpendicular to the printing path. A stop on the carriage is provided for defining a finite minimum gap between the print mechanism and the record medium. An overcentering toggle with a compression spring for biasing the print mechanism against the stop and for selectively allowing the print mechanism to be moved away from the stop.

BRIEF DESCRIPTION OF THE DRAWINGS

A complete understanding may be had of the present invention by referring to the accompanying detailed description when considered in conjunction with the accompanying drawings wherein like reference numbers refer to the same or similar parts throughout the several views in which.

DETAILED DESCRIPTION

Figure 1:
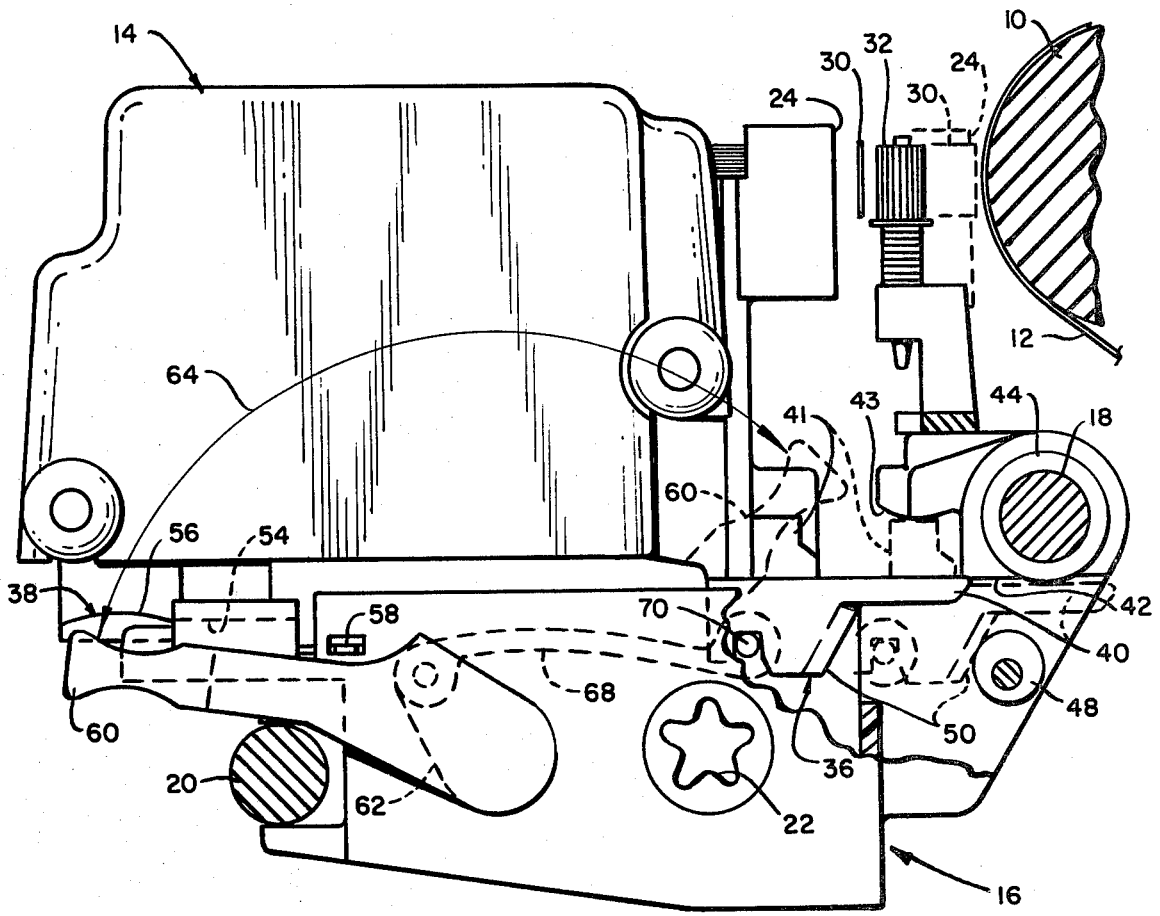
FIG. 1 is a side elevational view of a print mechanism and a carriage according to the present invention, shown partly in section.

Referring now to the accompanying drawings and more particularly to FIG. 1, a platen 10 is provided in a printing or typing machine for supporting a sheet of paper or other record medium 12. A print mechanism 14 similar to that shown in the abovementioned Bellino et al. patent is mounted on a carriage 16, for movement guided by a pair of guide rods 18 and 20.

The guide rods 18 and 20 have axes that extend parallel to the axis of the platen 10. The carriage 16, and with it the print mechanism 14, move in a direction parallel to the axes of the platen 10 and the guide rods 18 and 20 so as to span the width of the paper 12. Movement of the carriage 16 is under the control of a five-flute lead screw (not shown) that engages a lead screw nut fastened to the carriage and designated by the reference number 22. That is, as the lead screw is rotated, it moves the carriage 16 and with it the type print mechanism 14 in either direction across the width of the paper 12.

In FIG. 1 the print mechanism 14 is shown in the retracted position in which a considerable gap exists between the face 24 of the print mechanism 14 and the paper 12. In the retracted position shown in FIG. 1, a ribbon 30 can very easily be slipped between the face 24 and a pair of ribbon guides 32, one of which is positioned on either side of the face 24. Therefore, the ribbon 30 extends parallel with the platen 10 but spaced a good distance away from the paper 12.

The position of the print mechanism 14 shown in FIG. 1 is used principally to facilitate the insertion of a new ribbon into the machine. Once the ribbon is in position as shown in FIG. 1, the print mechanism is moved from the position shown in solid lines in FIG. 1 to the right to a position shown in which the face 24 and the ribbon 30 are shown in dotted lines in FIG. 1. The ribbon 30 is then pulled into very close proximity with the paper 12 but to a position very carefully controlled so as not to smudge the paper 12. The ribbon 30 is also stretched tightly across the face 24, and the print wires (not shown) can readily move from a position behind the ribbon 30 and behind the face 24 to press the ribbon 30 onto the paper 12 to squeeze ink out of the ribbon 30 onto the surface of the paper 12 to form an indicum thereon.

Figure 2:
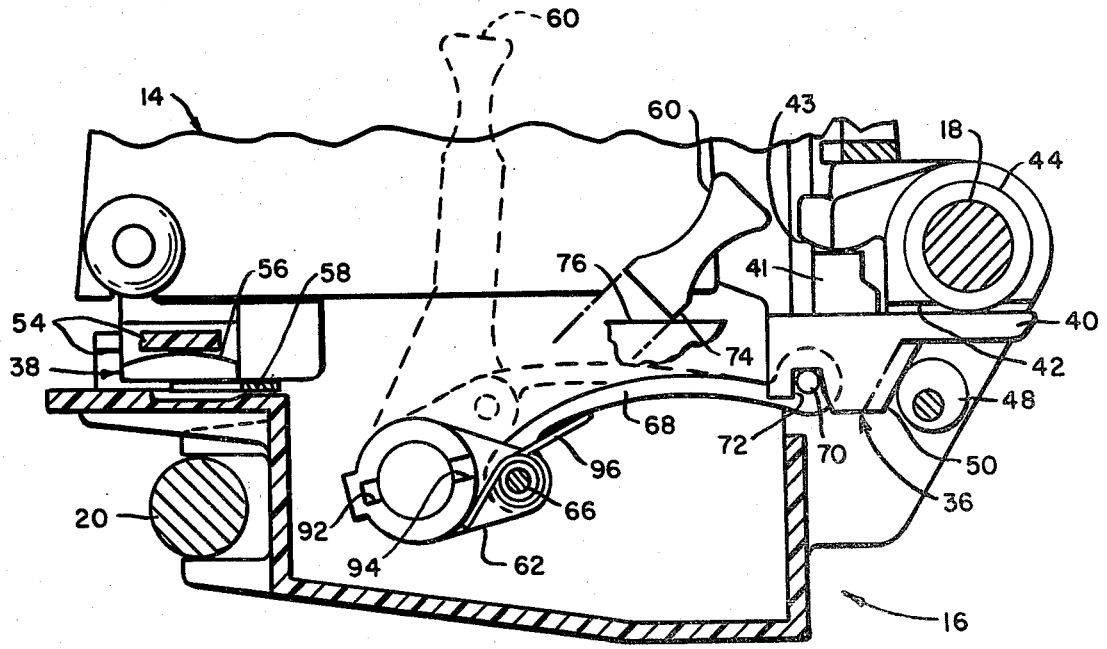
FIG. 2 is a detailed sectional view of the lower portion of carriage (as shown by the section lines 2—2 in FIGS. 3 and 4) showing a detail of operation of the biasing system.

At the bottom of the print mechanism 14 are two shaped projections 36 and 38. Referring to FIGS. 1 and 2, the projection 36 has a tongue 40, and a pair of wings 41, one on each side of and above the tongue 40. The tongue 40 is normally positioned under a flat surface 42 of the main carriage structure. As the print mechanism 14 is moved to the right as shown in FIGS. 1 and 2, the top surface of each of the wings 41 rides under and is positioned by a vertical stop 43 that is a part of the frame of the carriage 16. As the wings 41 bear against the vertical stops 43, the vertical elevation of the front of the print mechanism 14 is regulated.

Frictionally, rotatably mounted in the frame of the carriage 16 is an eccentric 48. A camming surface 50 on the projection 36 engages the eccentric 48, thereby determining the rightmost position of the print mechanism 14 as shown in FIGS. 1 and 2 and also cams the print mechanism upwardly towards the vertical stops 43. By reason of the frictional mounting of the eccentric 48 in the frame of the carriage 16, the eccentric 48 can be manually rotated, preferably with a suitable wrench, in order to determine how far to the right the print mechanism can be stopped in the carriage 16. This determines the gap between the face 24 of the print mechanism 14 and the paper 12. This gap is preferably adjusted only once during the operating life of the print mechanism, and it is desired that this adjustment never be disturbed when the operator changes ribbons in the machine.

A bushing 44 is rigidly mounted to the carriage 16 and is slideable on the guide rod 18. Together, the bushing 44 and the guide rod 18 form a bearing set. The bushing 44 is provided for wear longevity.

Figure 3:
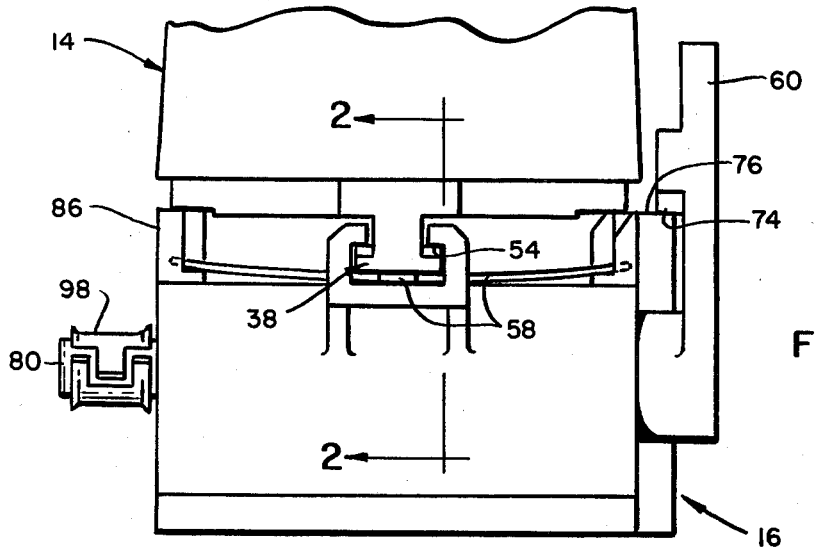
FIG. 3 is a detail view of the rear of the carriage showing the guiding and some biasing of the print mechanism in the carriage.

Referring now to FIGS. 1, 2, and 3, the projection 38 is preferably in the shape of an inverted T and slides in a U-shaped guide slot or channel 54 formed into the structure of the carriage 16. The two arms of the projection 38 have curved surfaces 56 which engage the channel 54 as the print mechanism 14 moves to the right in FIGS. 1 and 2. A T-shaped leaf spring 58 bears against and pushes upon the bottom of the projection 38 to keep the curved surfaces 56 of the projection 38 in engagement with the surfaces of the channel 54 in order to control the elevation of the rear of the print mechanism 14. Summarizing with the print mechanism 14 in its rightmost position in which it is very close to the paper 12, the vertical location of the front of the print mechanism 14 is controlled by the wings 41 bearing against vertical stops 43. The vertical location of the rear of the print mechanism 14 is then controlled by the surface 56 of the projection 38 bearing against the channel 54. The closeness of the print mechanism 14 to the paper 12 is controlled by the stop surface 50 and the eccentric 48.

The movement of the type mechanism 14 to the right towards the paper 12 and to the left away from the paper 12 for ribbon insertion is controlled by a bat handle 60. The bat handle 60 is connected to the crank 62 of an overcentering toggle which rotates with the bat handle 60 through a limited arc illustrated by the arrow 64 in FIG. 1. As the bat handle 60 is moved in the clockwise direction as viewed in FIGS. 1 and 2, it rotates the crank 62 from the position shown in dotted lines in FIG. 1 to the position shown in dotted lines in FIG. 2. The position of the bat handle and printing mechanism shown in solid lines in FIG. 1 is the fully retracted position for ribbon insertion. The position shown in dotted lines in FIG. 2 is the rightmost position of the print mechanism 14 with the stop surface 50 just barely touching the eccentric 48. The crank 62 carries a pivot 66 and a curved spring steel flexure link or compression spring 68 which is freely rotatable about the pivot 66 on the crank 62. The other end of the flexure link 68 carries a pin 70 which engages the print mechanism 14 in a channel 72 in the projection 36. This flexure link 68 is then the coupling between the bat handle 60 and the print mechanism 14 to move the print mechanism between its two extreme positions.

When the bat handle gets to the position shown in dotted lines in FIG. 2, further clockwise movement of the bat handle 60 does not significantly move the print mechanism 14 but bends the flexure link 68, pressing the stop surface 50 more tightly against the eccentric 48. Continued clockwise movement of the bat handle 60 moves the pivot 66 past a center line between the pin 70 and the axis of rotation of the bat handle 60 and begins slightly relaxing the flexure line 68. Therefore, the crank 62, the pivot 66, and the link 68 comprise an overcentering toggle. Well before the flexure link 68 can completely relax, a corner 74 on the bat handle 60 strikes a surface 76 on the carriage 16. The corner 74 and surface 76 prevent further clockwise rotation of the bat handle 60 and thus further relaxation of the flexure link 68. Consequently, the print mechanism 14 is locked tightly into position with the face 24 located a predetermined distance from the paper 12 and with the ribbon located in a predetermined relationship with respect to the axis of the platen 10.

Figure 4:
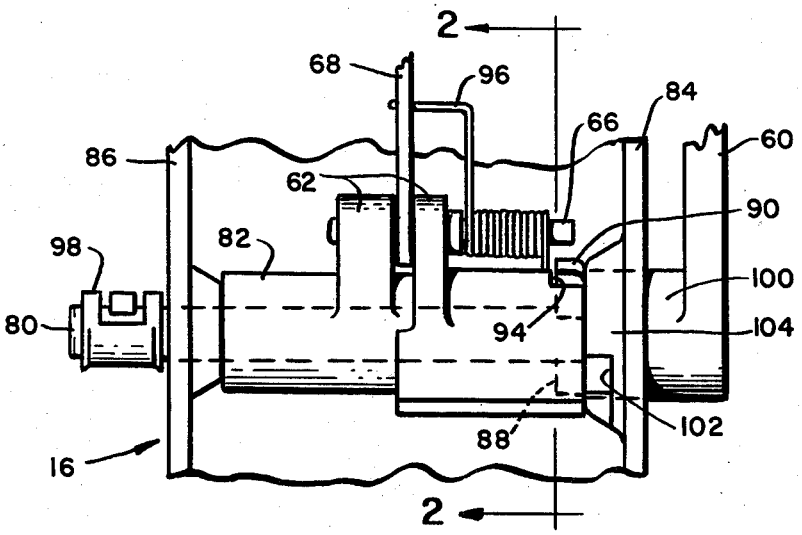
FIG. 4 is a detail of the overcentering toggle mechanism for positioning and biasing the print head.

The bat handle 60 is preferably formed of a single plastic part that includes a shaft 80 (FIGS. 4 and 5) that extends completely through the carriage 16. A sleeve 82 to which the two halves of the toggle crank 62 are firmly mounted, is rotatably mounted on the shaft 80 between the side frames 84 and 86 of the carriage 16 (FIG. 4). A pair of keys 88 and 90 projecting from the shaft 80 and the integral body of the bat handle 60 project into mating openings 92 and 94, respectively, (best seen in FIG. 2) in order to assure that the shaft 80 and the sleeve 82 rotate together. A torsion spring 96 is wrapped around the pivot 66 and biases the flexure link 68 upwardly as seen in FIG. 2 for ease of assembly. A retainer 98, such as a spring hose clamp or a sheet metal nut, is pressed over the end of the shaft 80 and grips the surface of the shaft 80 and bears against the side frame 86 in order to keep the bat handle 60 and the shaft 80 from moving to the right in FIG. 4. This retains the keys 88 and 90 in the openings 92 and 94, respectively, throughout the full arc of movement of the bat handle 60 as illustrated by the arrows 64. Actually, the counterclockwisemost extreme position of the bat handle 60 illustrated in FIG. 1 is determined by interference with the guide rod 20.

When the print mechanism 14 is in its leftmost position as shown in FIG. 1, the tongue 40 is still retained by the surface 42; and the surface 56 is still retained by the channel 54. This prevents the print mechanism 14 from being removed from the carriage 16 during the ribbon insertion operation.

Figure 5:
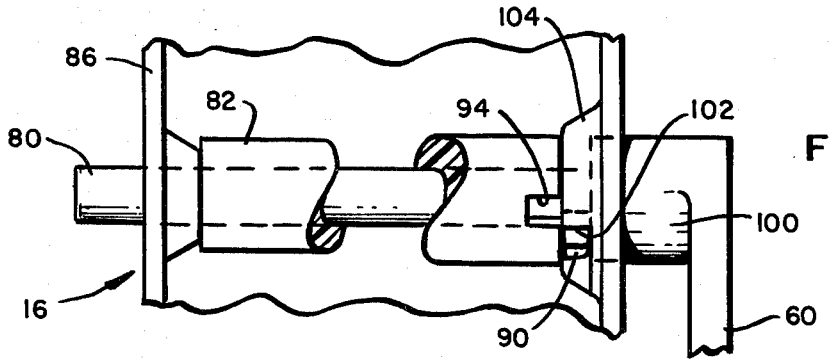
FIG. 5 is a partial detail of the positioning mechanism shown in FIG. 4 but shown in a different position in which the print mechanism is removable entirely from the carriage for maintenance or replacement.

When it is desired by a serviceman to remove the print mechanism 14 from the carriage 16, the retainer 98 is moved far enough on the shaft 80 enough to allow the bat handle to be moved to the position shown in solid lines in FIG. 1. At this position, the key 90 which projects to a larger diameter than the shank 100 of the bat handle 60, aligns with an opening 102 in a boss 104 on the side wall 84 of the carriage 16. Without the retainer 98, the shaft 80 and the bat handle 60 are free to move to the right as illustrated in FIG. 5 with the key 90 entering the opening 102 and disengaging from the opening 94. The key 88 also leaves the opening 92 at the same time that the key 90 leaves the opening 94. Therefore, there is then no interconnection between the bat handle 60 and the sleeve 82. The crank 62 is then free to rotate with the sleeve 82 about the shaft 80 so as to permit further leftward movement of the print mechanism 14 (FIG. 1) until the tongue 40 escapes from the surface 42 and the curved surface 56 escapes from the channel 54. The print mechanism 14 can then freely be lifted from the carriage 16 for repair, servicing, or replacement.

When a repaired, new, or replacement print mechanism 14 is to be mounted on the carriage 16, the spring 96 assures that the flexure link 68 is projecting upwardly at a convenient location for insertion of the pin 70 in the channel 72. The print mechanism 14 is then placed in the carriage 16 under the surface 42 and the curved surface 56 in the channel 54. The print mechanism 14 is then moved onto the position shown in solid lines of FIG. 1 until the opening 94 once again aligns with the opening 102 such that the key 90 can pass from the opening 102 to the opening 94 as the bat handle 60 and the shaft 80 are moved to the left (FIG. 5). The key 88 and the opening 92 are aligned when the key 90 and the opening 94 are aligned. These keys are made differently to prevent improper assembly.

When the shaft 80 is again moved to the left (FIG. 5) the retainer 98 is placed in the position shown in FIG. 4 and the print mechanism 14 is captured in the carriage 16 for insertion of a ribbon and suitable operation of the printer, assuming proper adjustment of the eccentric 48 to accommodate the new print mechanism 14.

Although only one specific embodiment of the invention is shown in the drawings, and described in the foregoing specification, it will be understood that invention is not limited to the specific embodiment described, but is capable of modification and rearrangement and substitution of parts and elements without departing from the spirit of the invention.

What is claimed is:

1. A carriage apparatus for mounting a print mechanism for movement in a path across the width of a record medium, along at least one fixed guide rod arranged parallel with the path, under control of means for advancing the carriage in either direction along the guide rod, the carriage including:

at least one bearing set for engagement with the guide rod;

at least one guide slot engagable by the print mechanism and offering the print mechanism a degree of movement in a direction perpendicular to the guide rod;

a stop for defining a finite minimum gap between the print mechanism and the record medium;

a shaft arranged parallel to the guide rod;

a handle for manually rotating the shaft;

a crank on the shaft;

a compression spring extending from the crank to the print mechanism for pushing the print mechanism into engagement with the stop as the shaft is manually rotated in a locking direction; and means for preventing rotation of the shaft in a direction opposite to the locking direction when the compression spring is pushing the print mechanism against the stop.

2. A carriage apparatus for mounting a spring mechanism for movement in a path across the width of a record medium, along at least one fixed guide rod arranged parallel with the path, under control of means for advancing the carriage in either direction along the guide rod, the carriage including:

means engagable by the print mechanism for offering the print mechanism a degree of movement in a direction perpendicular to the guide rod;

a stop for defining a finite minimum gap between the print mechanism and the record medium;

an overcentering toggle having a movable pivot;

a compression spring engaging at one end the printing mechanism and engaging at its other end the movable pivot for biasing the print mechanism against the stop; and manually-operable means for releasing the biasing means and for moving the print mechanism away from the stop.

3. A carriage apparatus according to claim 2 wherein the manually-operable means comprises a manually-movable bat handle connected to the overcentering toggle.

4. A carriage apparatus according to claim 3 further including: a shaft to which the bat handle is firmly fixed and a coupling element for engaging the shaft to the overcentering toggle.

5. A carriage apparatus according to claim 4 further including: means for normally holding the shaft in an axial position to maintain the coupling element in engagement between the shaft and the overcentering toggle.

6. A carriage apparatus for mounting a print mechanism for movement in a path across the width of a record medium, along at least one fixed guide rod arranged parallel with the path, under control of means for advancing the carriage in either direction along the guide rod, the carriage including:

means engagable by the print mechanism for offering the print mechanism a degree of movement in a direction perpendicular to the guide rod;

a stop for defining a finite minimum gap between the print mechanism and the record medium;

an overcentering toggle having a movable pivot, and a compression spring engaging at one end the printing mechanism and engaging at its other end the movable pivot for biasing the print mechanism against the stop;

a manually-movable bat handle; connected to the overcentering toggle;

a shaft to which the bat handle is firmly fixed;

a coupling element for engaging the shaft to the overcentering toggle, whereby movement of the bat handle releases the overcentering toggle and for moving the print mechanism away from the stop;

means for guiding a print ribbon in engagement with the print mechanism when the print mechanism is positioned in accordance with the stop;

means for normally holding the shaft in an axial position to maintain the coupling element in engagement between the shaft and the overcentering toggle; and an opening in the carriage for receiving the coupling element upon movement of the shaft against the normally-holding means, thereby decoupling the shaft from the overcentering toggle, for removal of the print mechanism from the carriage.

7. A carriage apparatus for mounting a print mechanism for movement in a path across the width of a record medium, along at least one fixed guide rod arranged parallel with the path, under control of means for advancing the carriage in either direction along the guide rod, the carriage including:

means engagable by the print mechanism for offering the print mechanism a degree of movement in a direction perpendicular to the guide rod;

a stop for defining a finite minimum gap between the print mechanism and the record medium;

an overcentering toggle mechanism including a flexure link for biasing the print mechanism against the stop; and manually-operable means for releasing the overcentering toggle and for moving the print mechanism away from the stop.

* * * * *